US008338757B2

(12) United States Patent
Isoda et al.

(10) Patent No.: US 8,338,757 B2
(45) Date of Patent: Dec. 25, 2012

(54) COOKING DEVICE

(75) Inventors: Keiko Isoda, Hyogo (JP); Hideaki Kobayashi, Hyogo (JP); Yoshiaki Ishio, Hyogo (JP); Hidekazu Suzuki, Hyogo (JP); Taihei Oguri, Hyogo (JP)

(73) Assignee: Panasonic Corporation, Osaka (JP)

( * ) Notice: Subject to any disclaimer, the term of this patent is extended or adjusted under 35 U.S.C. 154(b) by 466 days.

(21) Appl. No.: 12/669,614

(22) PCT Filed: Jul. 18, 2008

(86) PCT No.: PCT/JP2008/001926

§ 371 (c)(1),
(2), (4) Date: Jan. 19, 2010

(87) PCT Pub. No.: WO2009/011130

PCT Pub. Date: Jan. 22, 2009

(65) Prior Publication Data

US 2010/0187217 A1 Jul. 29, 2010

(30) Foreign Application Priority Data

Jul. 19, 2007 (JP) ..... 2007-187914

(51) Int. Cl.
*H05B 3/68* (2006.01)
*H05B 3/02* (2006.01)

(52) U.S. Cl. ..... 219/450.1; 219/492

(58) Field of Classification Search ..... 219/450.1, 219/492

See application file for complete search history.

(56) References Cited

U.S. PATENT DOCUMENTS

| | | | | | |
|---|---|---|---|---|---|
| 4,345,145 | A | * | 8/1982 | Norwood | 219/492 |
| 4,695,711 | A | * | 9/1987 | McGeorge | 219/506 |
| 4,968,515 | A | * | 11/1990 | Burkett et al. | 426/233 |
| 5,594,524 | A | | 1/1997 | Sasagaki et al. | |
| 5,847,365 | A | * | 12/1998 | Harter et al. | 219/492 |
| 6,066,837 | A | * | 5/2000 | McCormick et al. | 219/702 |

(Continued)

FOREIGN PATENT DOCUMENTS

DE 196 06 115 8/1996

(Continued)

OTHER PUBLICATIONS

English translation of International Preliminary Report on Patentability and Written Opinion of the International Searching Authority, issued Feb. 9, 2010, in PCT/JP2008/001926.

(Continued)

*Primary Examiner* — Colleen Matthews
(74) *Attorney, Agent, or Firm* — Wenderoth, Lind & Ponack, L.L.P.

(57) ABSTRACT

A cooking device includes a control mode switch selecting a control mode for controlling a heating operation; a setting switch for selecting a set value in each control mode; a heating control unit for controlling a heating unit based on the control mode and the set value inputted through the control mode switch and the setting switch; and a selection switch for selecting the operation mode. The operation modes include a first operation mode in which all of the plurality of control modes are set to be selectable and a second operation mode in which only part of the control modes are set to be selectable. The heating control unit disables at least one control mode switch when the second operation mode is selected by the selection switch.

11 Claims, 9 Drawing Sheets

U.S. PATENT DOCUMENTS

| | | | | |
|---|---|---|---|---|
| 6,198,080 | B1 | 3/2001 | Rice et al. | |
| 6,781,097 | B2 * | 8/2004 | Graff | 219/492 |
| 7,109,444 | B2 * | 9/2006 | Levy et al. | 219/492 |
| 2011/0000904 | A1 * | 1/2011 | Sakakibara et al. | 219/624 |

FOREIGN PATENT DOCUMENTS

| | | |
|---|---|---|
| GB | 2 359 381 | 8/2001 |
| JP | 7-219001 | 8/1995 |
| JP | 2003-208972 | 7/2003 |
| JP | 2005-9831 | 1/2005 |
| JP | 2005-308266 | 11/2005 |
| JP | 2006-171107 | 6/2006 |
| JP | 2007-173065 | 7/2007 |

OTHER PUBLICATIONS

International Search Report issued Sep. 16, 2008 in International (PCT) Application No. PCT/JP2008/001926.

Extended European Search Report issued Jun. 19, 2012 in corresponding European Application No. 08790228.4.

* cited by examiner

COOKING DEVICE

TECHNICAL FIELD

The present invention relates to a cooking device for heating a cooking container. In particular, the present invention relates to a cooking device including a plurality of operation switches to control cooking.

BACKGROUND ART

There is provided a cooking device which has an operation unit provided on a front surface of a main body serving as shell, and a cooking device which has an operation unit provided on a top plate for placing the cooking container. Moreover, there is provided a cooking device which has the operation units provided on both the top plate and the front surface of the main body (see e.g. Patent document 1). The operation unit is made up of a plurality of switches, each of which is assigned with a predetermined function.

Patent document 1: JP-A72003-208972

DISCLOSURE OF INVENTION

Problems to be Solved by the Invention

The number of functions provided in the cooking device is increasing in recent years. For example, functions such as a timer function for setting cooking time and an automatic cooking function for automatically performing water boiling, rice cooking, and the like are newly provided to the cooking device. Each of such functions is assigned to a switch, and thus the number of switches increases as the number of functions increases. The operation becomes complicating if the number of switches is increased with an increase in the number of functions of the device, and a target operation becomes difficult to perform for a user who does not require all the functions. Thus, there arises a problem in that an operating error of the user increases. Such a problem is especially serious to the user who does not require many functions or who cannot make sufficient use of the functions.

In view of solving the problems of the related art, it is an object of the present invention to provide a cooking device including a plurality of switches that is easy to use for users who require only part of the functions of the cooking device.

Means for Solving the Problems

A cooking device according to the present invention includes: a main body serving as shell; a top plate provided on an upper surface of the main body; a heating unit operable to heat an object to be heated placed on the upper surface of the main body; at least one control mode switch operable to select one of a plurality of control modes for controlling a heating operation of the heating unit; at least one setting switch operable to select a set value in each control mode; a heating control unit operable to control the heating unit based on the control mode and the set value inputted through the control mode switch and the setting switch; and a selection switch operable to select one operation mode from a plurality of operation modes; wherein the operation modes include a first operation mode in which all of the plurality of control modes are set to be selectable and a second operation mode in which only part of the plurality of control modes are set to be selectable; and the heating control unit sets only the control mode switch and the setting switch necessary for the control modes which are set to be selectable in the operation mode selected by the selection switch to be enabled. With this configuration, there is provided a cooking device that can respond with a simple switching to both a user who can perform complicating operations and attempts to use a great number of functions, and a user who uses only simple functions and desires easy operation.

The cooking device may further include a first notifying unit operable to notify distinctively the enabled control mode switch and the enabled setting switch from the disabled control mode switch and the disabled setting switch in the second operation mode. The user can thus know which switch is operable. For example, the switch itself may be illuminated or non-illuminated to notify the enabled control mode switch and the enabled setting switch, and the disabled control mode switch and the disabled setting switch in a distinguished manner.

The enabled control mode switch and the enabled setting switch may be arranged adjacent to at least one other enabled control mode switch or enabled setting switch in the second operation mode. The user can thus easily determine the usable control mode switch and the usable setting switch, and the unusable control mode switch and the unusable setting switch.

The cooking device may further include a second notifying unit operable to notify whether the cooking device is operating in the first operation mode or in the second operation mode; wherein when the disabled control mode switch or setting switch is operated, at least one of the first notifying unit or the second notifying unit may notify that the operated control mode switch or the operated setting switch is disabled. With this configuration, when the user mistakenly operates the unusable control mode switch or the unusable setting switch, the user can be notified of the mistake.

An operation of the selection switch may be hard to be accepted compared to operations of the control mode switch and the setting switch. The operation mode is thus not easily changed even when the user touches the selection switch by mistake while operating another switch.

The selection switch may be a switch which has an electrical contact and is operable to open or close; and the control mode switch and the setting switch may be touch switches of electrostatic capacity type. The operation mode is thus not easily changed even when the user touches the selection switch by mistake while operating another switch.

The cooking device may further include: a power switch operable to disable all operations in an OFF state of the power switch and to enable at least one switch to be operated in an ON state of the power. switch; and a non-volatile memory operable to store the operation mode selected by the selection switch when the power switch is in the ON state; wherein the cooking device may be operate in the stored operation mode when the power switch is turned from off to on. With this configuration, the operation mode can be stored even after the main power of the device is turned off, and the device can be started up at the previously set operation mode when the main power is turned on the next time.

Effects of the Invention

According to the present invention, the user can select the first operation mode in which all control modes can be used and a second operation mode in which only part of the control modes can be used since a selection switch for switching the operation modes is provided. Thus, with one cooking device, all controls modes can be provided in the first operation mode to the user who desires to use all the functions, and only part of the control modes can be provided in the second operation mode to the user who only uses some functions. Therefore, even with the cooking device including a plurality of switches, the types of selectable control modes and the number of usable switches can be reduced with the switching operation of the selection switch for the user who requires only some functions. Thus, an operating error by the user who does not require a great number of functions or who cannot make sufficient use of the functions can be prevented, and convenience is enhanced even to such users.

DESCRIPTION OF REFERENCE NUMERALS

Figure 1:
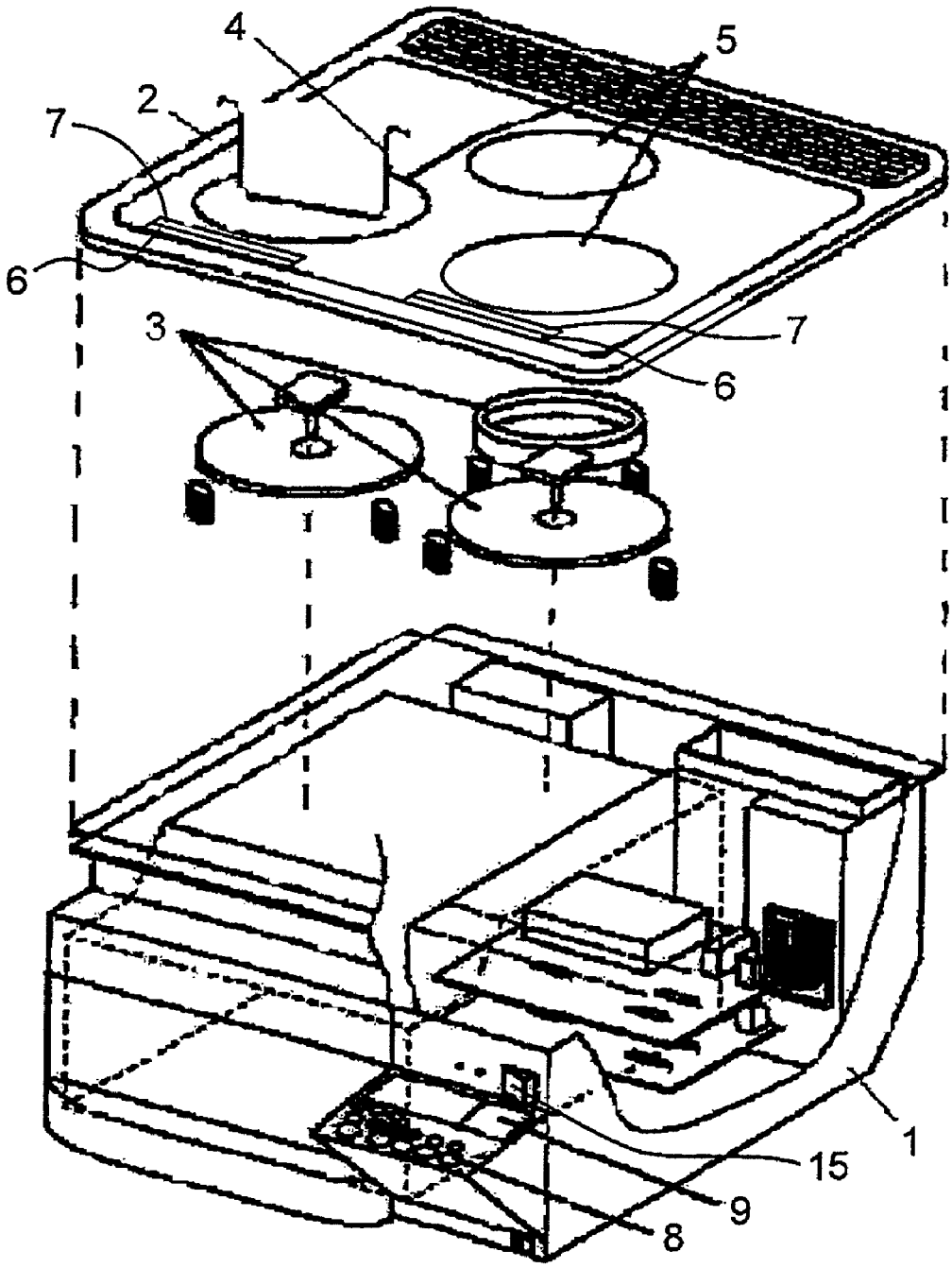
FIG. 1 is an overall configuration diagram of a cooking device according to first and second embodiments of the present invention.

1 main body
2 top plate (top panel)
3 heating unit
4 cooking container (object to be heated)
6 top surface operation unit
6*a* unlock switch (control mode switch)
6*b* timer switch (setting switch, control mode switch)
6*c* automatic switch (control mode switch)
6*d* fried-food ON/OFF switch (control mode switch)
6*e* down switch (setting switch)
6*f* up switch (setting switch)
6*g* heating ON/OFF switch (control mode switch)
7 top surface display unit
8 front surface operation unit
8*a* selection switch
9 front surface display unit
10 heating control unit
15 power switch

BEST MODE FOR CARRYING OUT THE INVENTION

Embodiments of the present invention will be described below with reference to the drawings. It should be noted that the present invention is not limited to the embodiments.

(First Embodiment)

FIG. 1 shows a configuration of a cooking device according to a first embodiment of the present invention. In the cooking device of FIG. 1, a top plate 2 made of crystallized ceramic, which is a top panel, is provided on the upper surface of a main body 1 serving as shell. Below the top plate 2 of the main body 1, there is arranged a heating unit 3 for heating a cooking container 4, which is an object to be heated, placed on the top plate 2. In FIG. 1, three heating units 3 are arranged. Such heating units 3 are respectively configured by an induction heating coil for heating the cooking container 4 by induction heating, or a radiant heater for heating a pan that is not suited for induction heating. A heating display unit 5 for indicating a user a location to place the cooking container 4 is provided at a position facing the heating unit 3 on the surface of the top plate 2. For example, in a case of a gas cooker, a through-hole may be formed in the top plate 2 forming the upper surface of the device, and a gas burner may be provided at the portion of the through-hole as the heating unit. In such a case, the object to be heated is placed on the gas burner that forms the upper surface of the main body.

A top surface operation unit 6 including switches assigned with commands such as start and stop of heating of the heating unit 3 is arranged in substantially the same plane as the top plate 2. A top surface display unit 7 for displaying various states according to the operation of the top surface operation unit 6 is arranged on the top plate 2. The top surface display unit 7 is a notifying unit for notifying various states to the user by a liquid crystal, an LED, and the like. For example, when a switch that is set to be unusable is operated, the top surface display unit 7 notifies the user that the switch cannot be operated by flashing the LED, and the like.

A front surface operation unit 8 of open/close storage type and a front surface display unit 9 for displaying various states according to the operation of the front surface operation unit 8 are provided on the front surface of the main body 1. The front surface display unit 9 is a notifying unit for notifying the user of various states by a liquid crystal, an LED, and the like.

Figure 2:
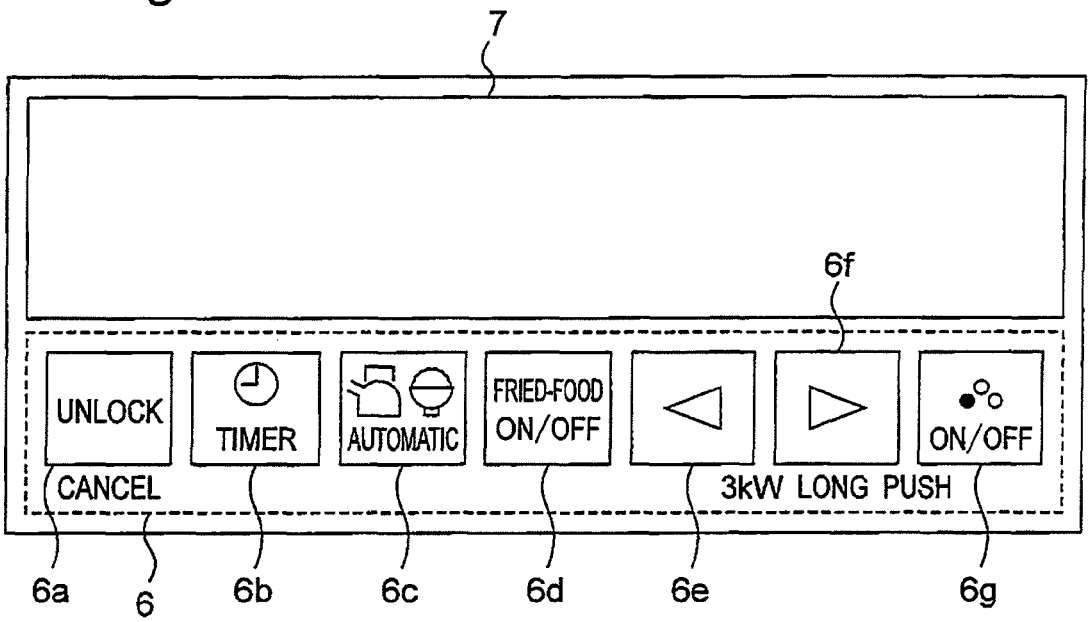
FIG. 2 is a view showing a top surface operation unit and a top surface display unit in the first and second embodiments of the present invention.

FIG. 2 shows the top surface operation unit 6 and the top surface display unit 7 arranged on the top plate 2. The top surface operation unit 6 forms a touch switch of electrostatic capacity type for performing switch operation when the surface of the top plate 2 is touched in the case of arranging an electrode at the back surface of the top plate 2 and applying a high frequency voltage to the relevant electrode. The top surface operation unit 6 includes an unlock switch 6*a* assigned with a function of changing a control mode of the cooking device to a control mode in which the switch operations of the switches 6*b* to 6*g* of the top surface operation unit 6 can be performed; a timer switch 6*b* for transitioning to a timer mode as well as for setting a cooking time (set value) in a heating mode; an automatic switch 6*c* assigned with a function for selecting a control mode of automatically performing water boiling and rice cooking; a fried-food ON/OFF switch 6*d* used when selecting a fried-food cooking mode; a down switch 6*e* for lowering heating power and a temperature (set value); an up switch 6*f* for raising the heating power and the temperature (set value); and a heating ON/OFF switch 6*g* for changing from a stop mode to the heating mode and changing from the heating mode to the stop mode.

The cooking device of the present embodiment has control modes including an unlock mode, the timer mode, an automatic cooking mode, a fried-food mode, and the heating mode, where the unlock switch 6*a*, the automatic switch 6*c*, the fried-food ON/OFF switch 6*d*, and the heating ON/OFF switch 6*g* correspond to the control mode switch for selecting the control mode. The timer switch 6*b*, the down switch 6*e*, and the up switch. 6*f* are setting switches for selecting a set value in each control mode. The timer switch 6*b* is a setting switch, and at the same time, is used as a control mode switch for transitioning to the timer mode. Thus, the setting switch and the control mode switch maybe made up of one switch.

Figure 3:
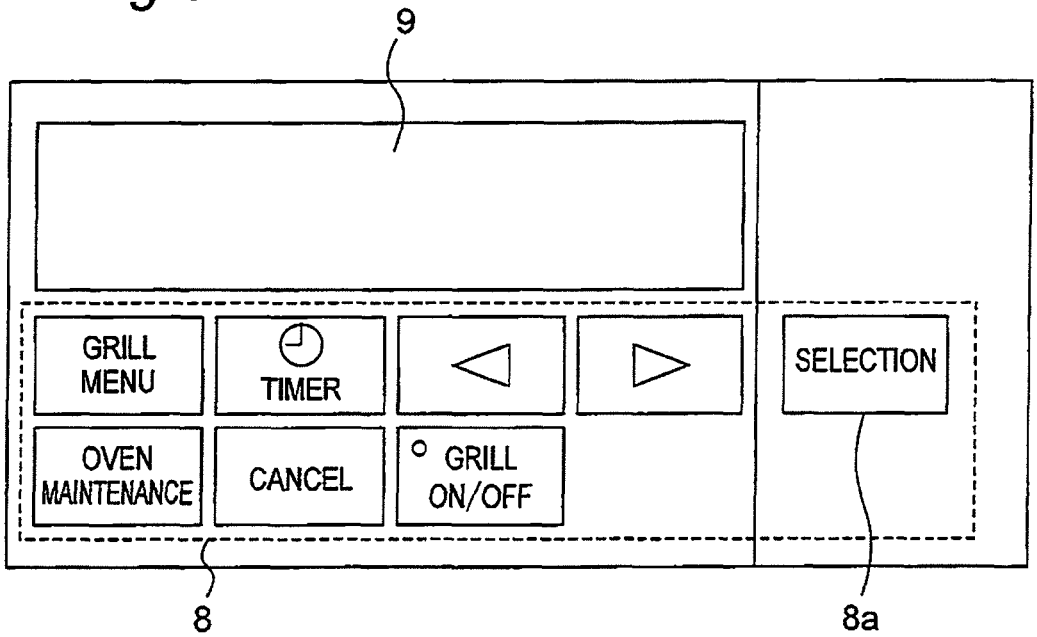
FIG. 3 is a view showing a front surface Operation unit and a front surface display unit in the first and second embodiments of the present invention.

FIG. 3 shows the front surface operation unit 8 and the front surface display unit 9 arranged on the front surface of the main body 1. The front surface operation unit 8 includes a selection switch 8*a* for switching between a first operation mode (hereinafter also referred to as "full mode") enabling all functions of the cooking device, and a second operation mode (hereinafter also referred to as "simple mode") for limiting the enabled functions. In the full mode, all control modes are set to be selectable, and all switches 6*a* to 6*g* of the top surface operation unit 6 are set to be enabled. In the simple mode, only the heating mode of the control modes is set to be selectable, and only the down switch 6*e*, the up switch 6*f*, and the heating ON/OFF switch 6*g* used in the heating mode are set to be enabled.

Figure 4:
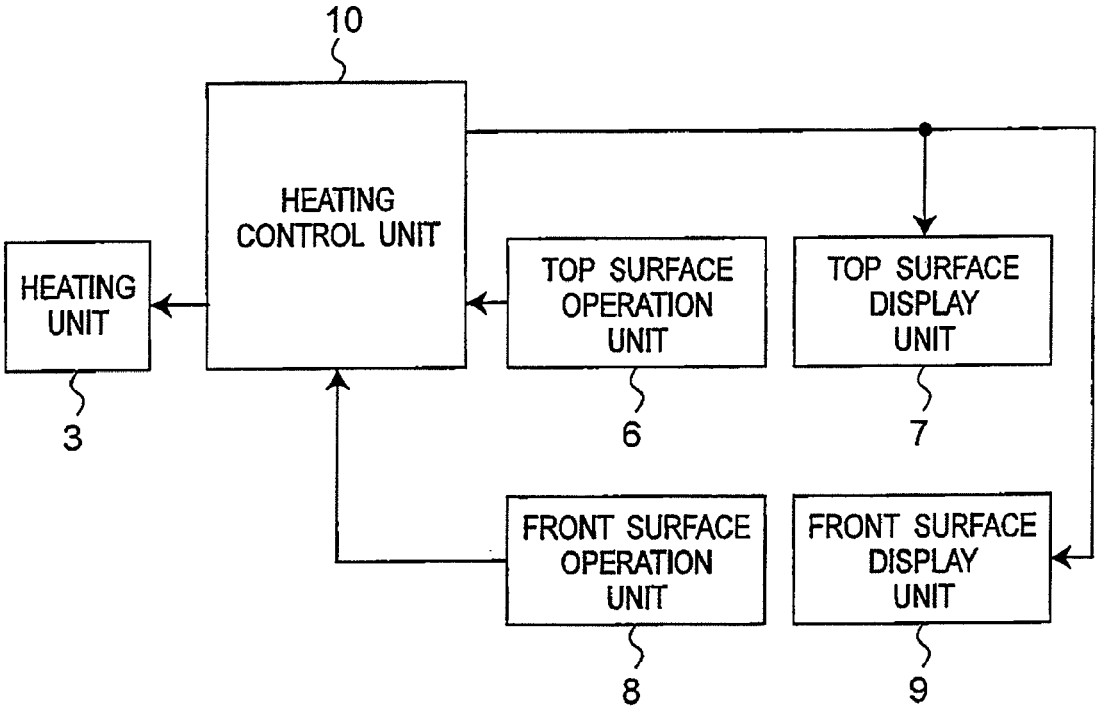
FIG. 4 is a block diagram showing the cooking device of the first embodiment of the present invention.

FIG. 4 is a block diagram showing a configuration of the cooking device of the present embodiment. The cooking device of the present embodiment includes a heating control unit 10 for controlling the heating unit 3 and switching the number of enabled control modes based on the operation of the selection switch 8*a*. The heating control unit 10 controls the heating unit 3 based on the switch operations of the top surface operation unit 6 and the front surface operation unit 8. The heating control unit 10 sets the control mode selectable by the top surface operation unit 6 according to the operation mode selected by the selection switch 8*a*. Further, the heating control unit 10 switches so that only the setting switch necessary for the execution of the relevant control mode can be operated, and displays the control mode switch and the setting switch usable at the top surface display unit 7 and switches to perform a display showing the operation mode currently selected at the front surface display unit 9.

In the present embodiment, when the selection switch 8*a* is continuously pushed for three or more seconds, the heating control unit 10 accepts the operation of the selection switch 8*a*, and switches from the full mode to the simple mode or from the simple mode to the full mode. When the switch other than the selection switch 8*a* in the top surface operation unit 6 and the front surface operation unit 8 is continuously pushed for one or more seconds, the heating control unit 10 accepts the operation of such a switch.

Figure 5A:
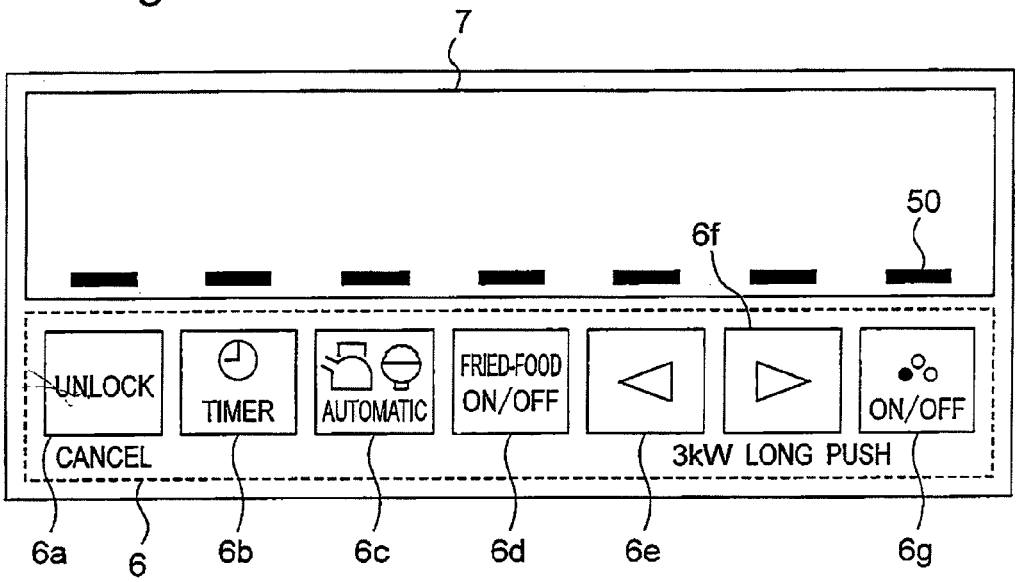
FIGS. 5A and 5B are views showing a display example of a full mode after power is turned on in the first and second embodiments of the present invention.
Figure 5B:
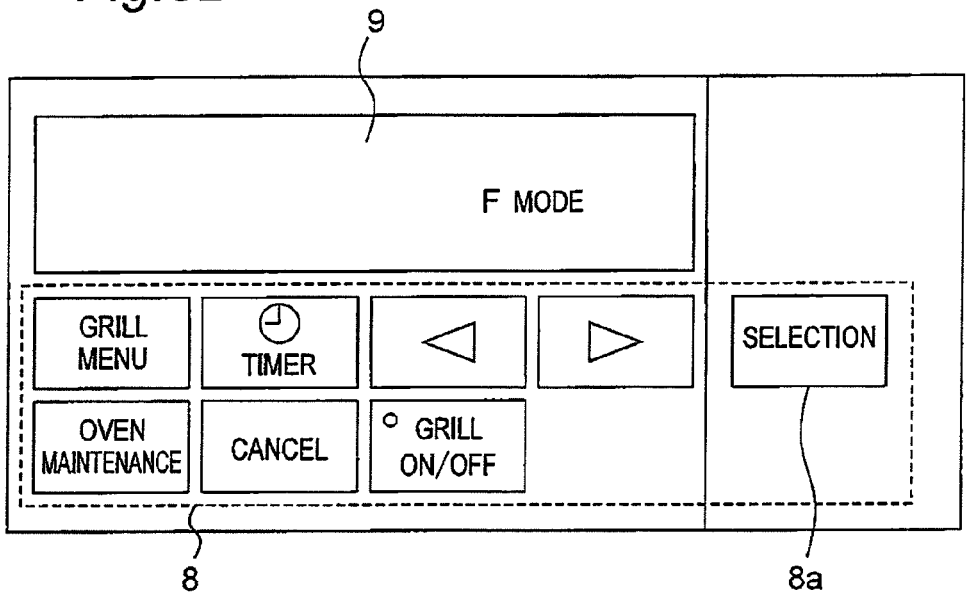

FIG. 5A. shows a state of the top surface operation unit 6 and the top surface display unit 7 when the power switch 15 is turned on, and FIG. 5B shows a state of the front surface operation unit 8 and the front surface display unit 9 when the power switch 15 is turned on. When the power switch 15 is turned on, the cooking device starts up in the full mode in which all control modes of the cooking device are selectable. In this case, the unlock mode, the timer mode, the automatic cooking mode, the fried-food mode, and the heating mode are all set to be selectable, and all switches 6*a* to 6*g* of the top surface display unit 7 are set to be enabled, an indication 50 by the light-emitting element is displayed at the upper part of all switches of the top surface display unit 7 to show that all switches 6*a* to 6*g* are usable, as shown in FIG. 5A. In this case, characters "F mode" indicating the full mode are displayed on the front surface display unit 9.

The operation of starting the heating of the cooking container 4 (operation of starting the heating mode) when the full mode is selected is carried out through a procedure of operating the unlock switch 6*a* (first procedure), and operating the heating ON/OFF switch 6*g* (second procedure). The unlock switch 6*a* is in a enabled state when the selection switch 8*a* of the front surface operation unit 8 is operated and the simple mode is not selected, and thus the heating control unit 10 controls the heating unit 3 to start heating when accepting the operation of the unlock switch 6*a* and then accepting the operation of the heating ON/OFF switch 6*g*.

Figure 6A:
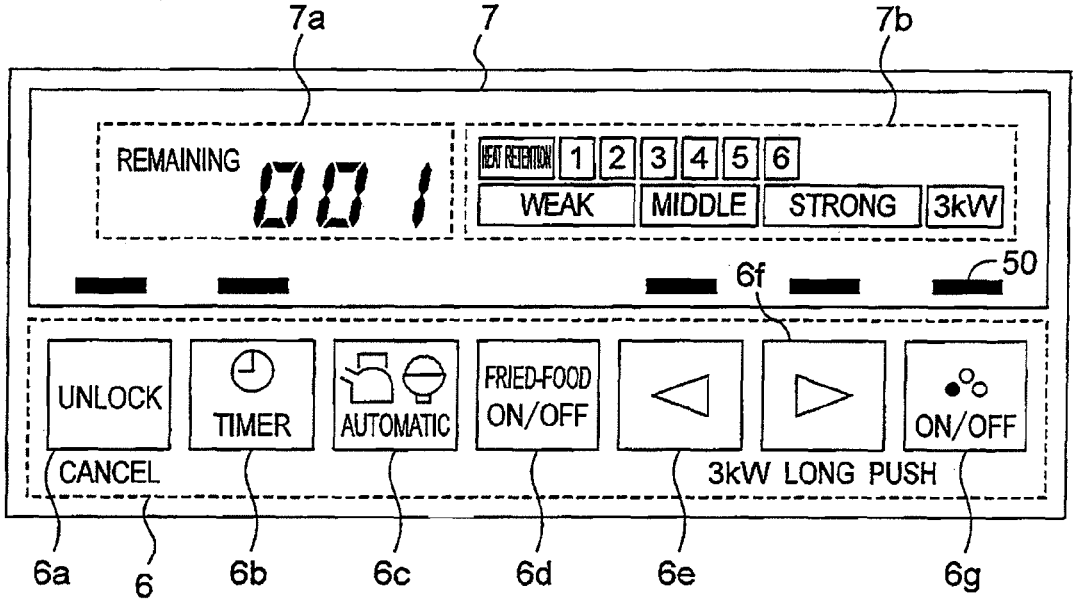
FIGS. 6A and 6B are views showing a display example during heating in the full mode in the first and second embodiments of the present invention.
Figure 6B:
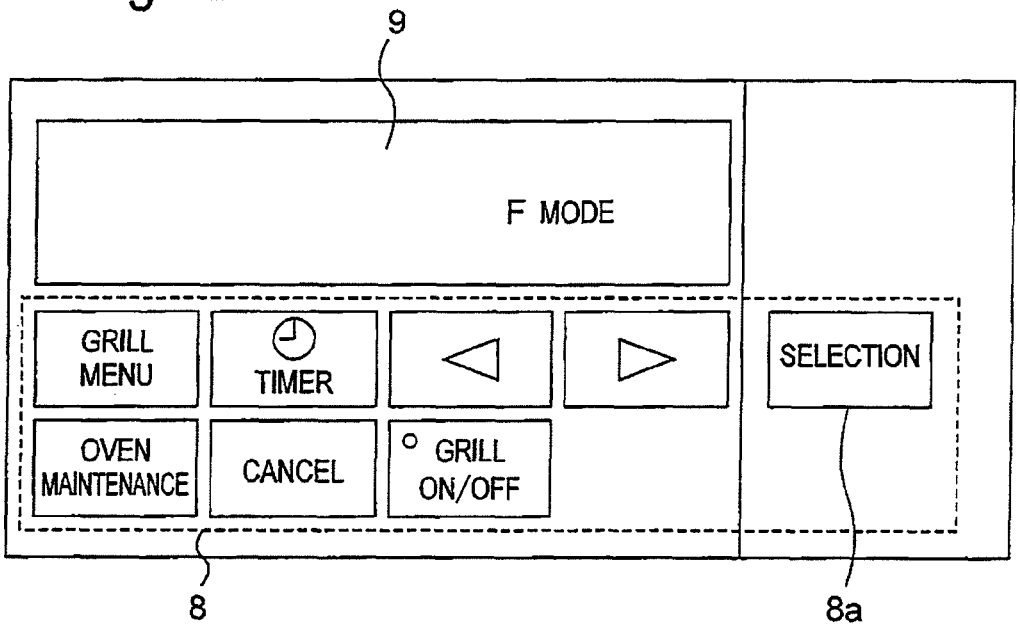

FIG. 6A shows a state of the top surface operation unit 6 and the top surface display unit 7 when the heating mode is selected and heating is being carried out in the full mode, and FIG. 6B shows a state of the front surface operation unit 8 and the front surface display unit 9 when the heating mode is selected and heating is being carried out in the full mode. During heating, a heating power set value 7*b* and a timer set time 7*a* are displayed in the top surface display unit 7. When the heating mode is selected and heating is being carried out in the full mode, a selecting function of the heating power set value by the operation of the down switch 6*e* (setting switch) and the up switch 6*f* (setting switch), a selecting function of the time set value of the cooking timer by the timer switch 6*b* (setting switch), and a stop function of heating by the heating ON/OFF switch 6*g* (control mode switch) are usable. The indication 50 by the light-emitting element is displayed in the top surface display unit 7 at the upper part of the usable switches 6*a*, 6*b*, 6*e*, 6*f*, and 6*g*. Even if the switches 6*c* and 6*d* without the indication 50 are operated, the control unit 10 does not accept the operation thereof. Therefore, in the full mode, the enabled control mode switch and the enabled setting switch, and the disabled control mode switch and the disabled setting switch are notified in a distinguished manner according to the selected control mode (heating mode in the case of FIG. 6).

When a switch without the indication 50 is operated for one or more seconds, the user is notified that the switch operated by the top surface display unit 7 is unusable. For example, when the disabled switch is operated, the top surface display unit 7 blinks the indication 50 corresponding to the operated switch for a predetermined period of time.

Figure 7A:
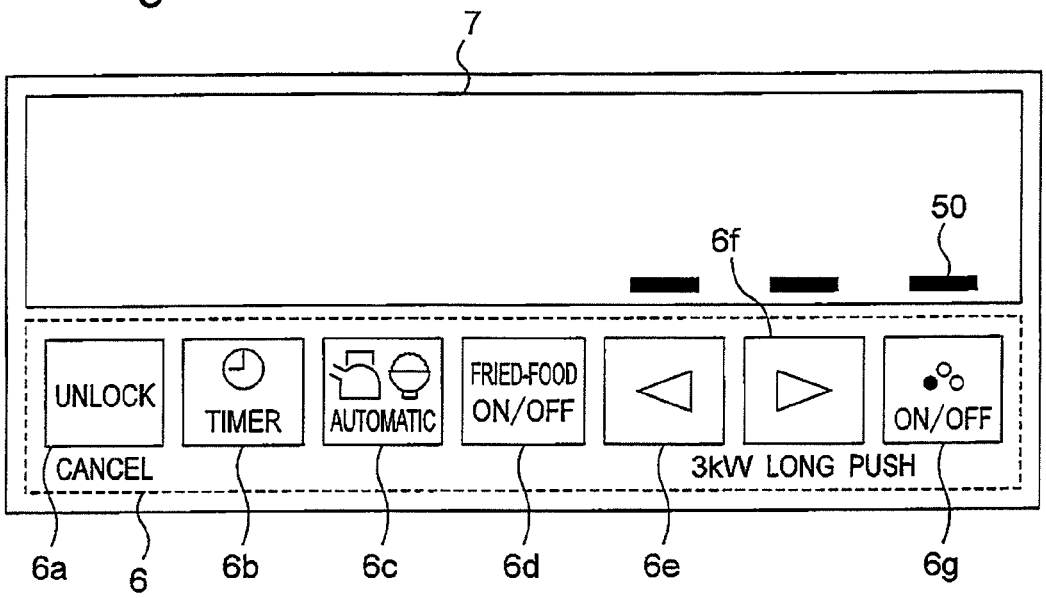
FIGS. 7A and 7B are views showing a display example of a simple mode after the power is turned on in the first and second embodiments of the present invention.
Figure 7B:
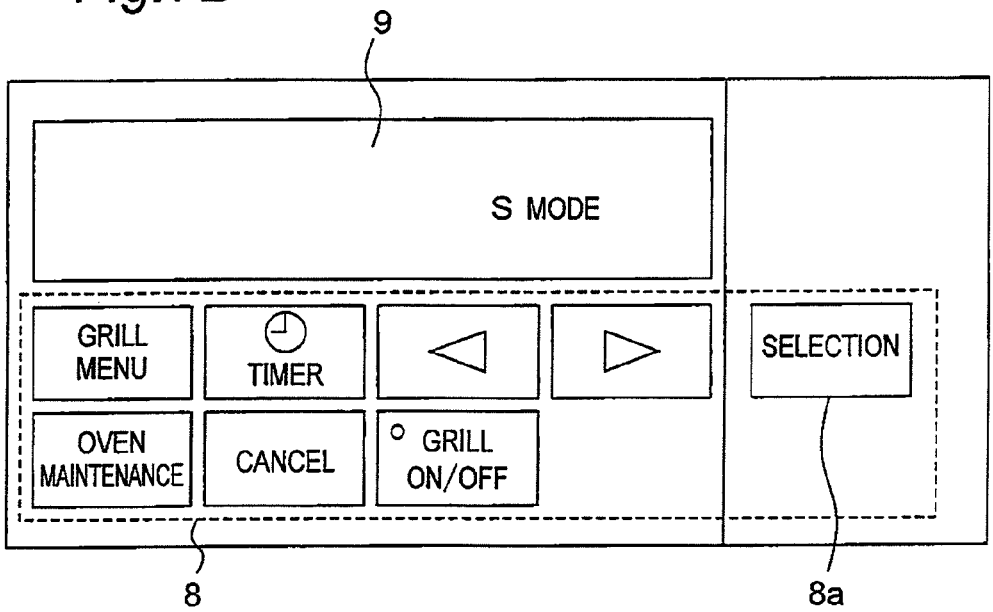

FIG. 7A shows a state of the top surface operation unit 6 and the top surface display unit 7 when switched to the simple mode after the power is turned on, and FIG. 7B shows a state of the front surface operation unit 8 and the front surface display unit 9 when switched to the simple mode after the power is turned on. When the selection switch 8*a* of the front surface operation unit 8 is operated after the power is turned on, the cooking device transitions from the full mode to the simple mode. In the simple mode, only the heating mode is selectable; only the down switch 6*e*, the up switch 6*f*, and the heating ON/OFF switch 6*g* used in the heating mode are enabled; and the indication 50 indicating that the switches are enabled is displayed by the light-emitting element over the switches 6*e*, 6*f*, 6*g*. This indicates that the switches 6*a*, 6*b*, 6*c*, 6*d* without the indication 50 cannot be operated. Therefore, in the simple mode as well, the enabled control mode switch and the enabled setting switch, and the disabled control mode switch and the disabled setting switch are notified in a distinguished manner. Furthermore, in the simple mode, characters "S mode" indicating the simple mode are displayed in the front surface display unit 9.

As shown in FIG. 7A, the down switch 6*e*, the up switch 6*f*, and the heating ON/OFF switch 6*g*, which operation is valid in the simple mode, are arranged adjacent to at least one switch, which operation is valid. The user can thus easily distinguish the usable control mode switch and the usable setting switch from the unusable control mode switch and the unusable setting switch.

The operation of starting heating of the cooking container 4 (operation of starting heating mode) in the simple mode is carried out only by operating the heating ON/OFF switch 6*g*

(first procedure). In the simple mode, the heating control unit 15 sets the unlock switch 6*a* to be disabled, and thus the heating control unit 10 controls the heating unit 3 and starts heating immediately after accepting the operation of the heating ON/OFF switch 6*g*. In the simple mode, the unlock switch 6*a* is set to be disabled, and thus the heating control unit 10 does not accept the operation of the unlock switch 6*a* and the top surface display unit 7 does not change even if the operation of the unlock switch 6*a* is performed before the operation of the heating ON/OFF switch 6*g*.

Figure 8A:
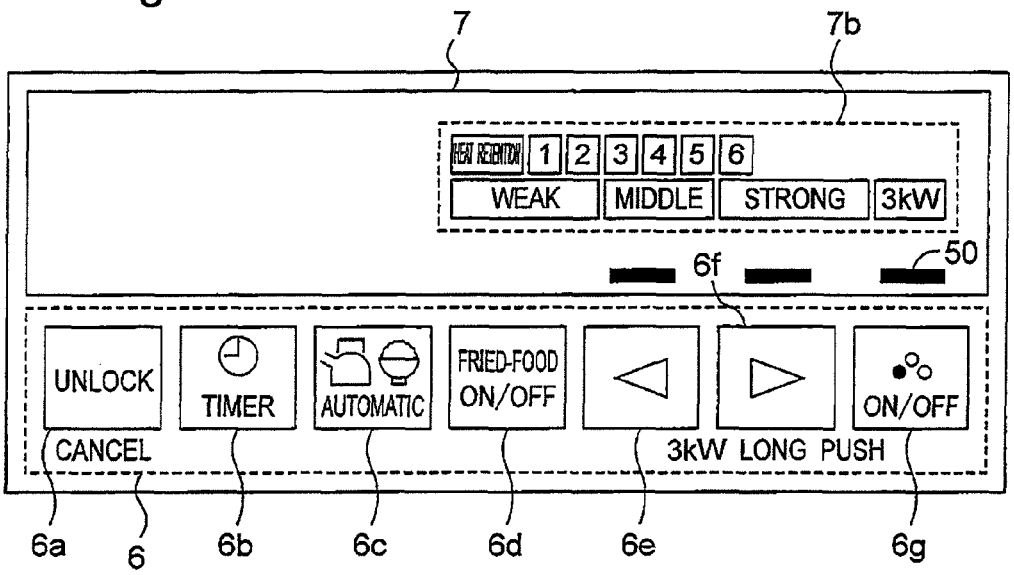
FIGS. 8A and 8B are views showing a display example during heating in a simple mode in the first and second embodiments of the present invention.
Figure 8B:
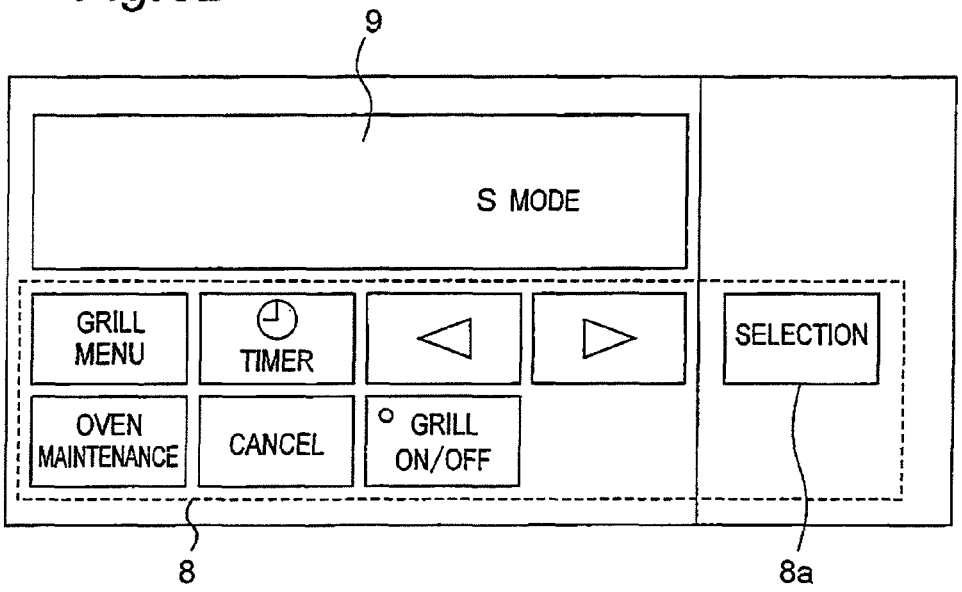

FIG. 8A shows a state of the top surface operation unit 6 and the top surface display unit 7 when the heating mode is selected and heating is being carried out in the simple mode, and FIG. 8B shows a state of the front surface operation unit 8 and the front surface display unit 9 when the heating mode is selected and heating is being carried out in the simple mode. In the simple mode, the heating power set value 7*b* is displayed in the top surface display unit 7 during heating. In the simple mode, the timer set time 7*a* shown in FIG. 6A is not displayed since the timer function cannot be used. During heating in the simple mode, the adjustment function of the heating power by the operation of the down switch 6*e* and the up switch 6*f*, and the stop function of heating by the heating ON/OFF switch 6*g* are usable. The indication 50 by the light-emitting element is displayed in the top surface display unit 7 over the usable switch. Even if the switch without the indication 50 is operated, the heating control unit 10 does not accept the operation thereof.

Therefore, in the present embodiment, the number of selectable control modes is changed and only the switches necessary for the selectable control mode are made enabled, by the operation of the selection switch 8*a*. Therefore, the operation procedure for starting heating also changes according to the selected operation mode.

As described above, a user who desires to use all the functions does not operate the selection switch 8*a* after turning on the power and performs the operation with the "F mode" displayed on the front surface display unit 9, so that heating can be performed in a state where a great number of functions can be used with a great number of switches that can be used.

A user who does not need to use all the functions and desires to perform heating with a simple operation operates the selection switch 8*a* and performs the operation with the "S mode" displayed on the front surface display unit 7, so that the number of switches that can be used is reduced, and heating and adjustment of the heating power can be carried out with a simpler operation.

Therefore, even if the device is the same, changes such as simplifying the operation procedure or quitting simplification and returning to the original mode can be easily carried out by changing the number of selectable control modes and having only the switches necessary for the relevant control mode enabled. Thus, a great number of functions can be provided to the user who can master complicating operations, whereas a simple operation procedure can be provided to the user who cannot perform complicating operations. An operating error of the user who cannot make sufficient use of the functions can be prevented, and a cooking device that is very easy to use for the user who requires only part of the functions of the cooking device is realized.

The correct operation can be induced by notifying the user with the top surface display unit 7 when the switch set to be disabled is operated.

Furthermore, since the usable switch is arranged to be adjacent to at least another usable switch in the simple mode, a plurality of enabled switches can be grouped, and the user can more easily distinguish the usable switch from the unusable switch. The operation is thus easier to perform.

Moreover, since the time (three seconds) required to accept the operation of the selection switch 8*a* is set longer than the time (one second) required to accept the operations of the switches 6*a* to 6*g* of the top surface operation unit 6, the operation of the selection switch 8*a* is hard to accept in comparison with the operations of the control mode switches 6*a*, 6*c*, 6*d*, 6*g* and the setting switches 6*b*, 6*e*, 6*f*. Therefore, the selection switch 8*a* is prevented from being carelessly operated. The selection switch 8*a* is thus prevented from being unconsciously operated by the user.

In the present embodiment, the time required for accepting the switch is set to one second and three seconds for the switches 6*a* to 6*g* of the top surface operation unit 6 and the selection switch 8*a*, respectively, but such time is not limited to the present embodiment. In addition, the number of operations required for accepting the switch may be arbitrarily set. For example, the function assigned to the switch may be executed when the switch is operated a plurality of times within a certain period of time. In this case, the number of operations (e.g., two times) required for accepting the selection switch 8*a* within the certain period of time is set greater than the number of operations (e.g., once) required for accepting the switches 6*a* to 6*g* of the top surface operation unit 6, so that the operation of the selection switch 8*a* is harder to accept than the operation of the control mode switches 6*a*, 6*c*, 6*d*, 6*g* and the setting switches 6*b*, 6*e*, 6*f*. When the selection switch 8*a* and the other switch are simultaneously operated, the other switch is accepted and the selection switch 8*a* is not accepted, so that the selection switch 8*a* is harder to accept than the other switch.

In the present embodiment, when the switch set to be disabled is operated, the top surface display unit 7 notifies the user that such switch cannot be operated, but the front surface display unit 9 may notify the user that the switch cannot be operated, instead of the top surface display unit 7.

The operation of the selection switch 8*a* may be performed at any time, or the operable timing thereof can be limited. For example, operation may be possible only within a predetermined time after the power is turned on.

In the present embodiment, the switching from the full mode to the simple mode and the switching from the simple mode to the full mode are enabled by the selection switch 8*a*, but only the switching from the full mode to the simple mode may be enabled by the operation of the selection switch 8*a*, and the mode may be returned to the full mode every time the power of the cooking device is turned on.

In the present embodiment, the cooking device has two operations modes, the full mode and the simple mode, but three or more operation modes may be provided. The enabled function may be set according to the respective operation modes.

(Second Embodiment)

Figure 9:
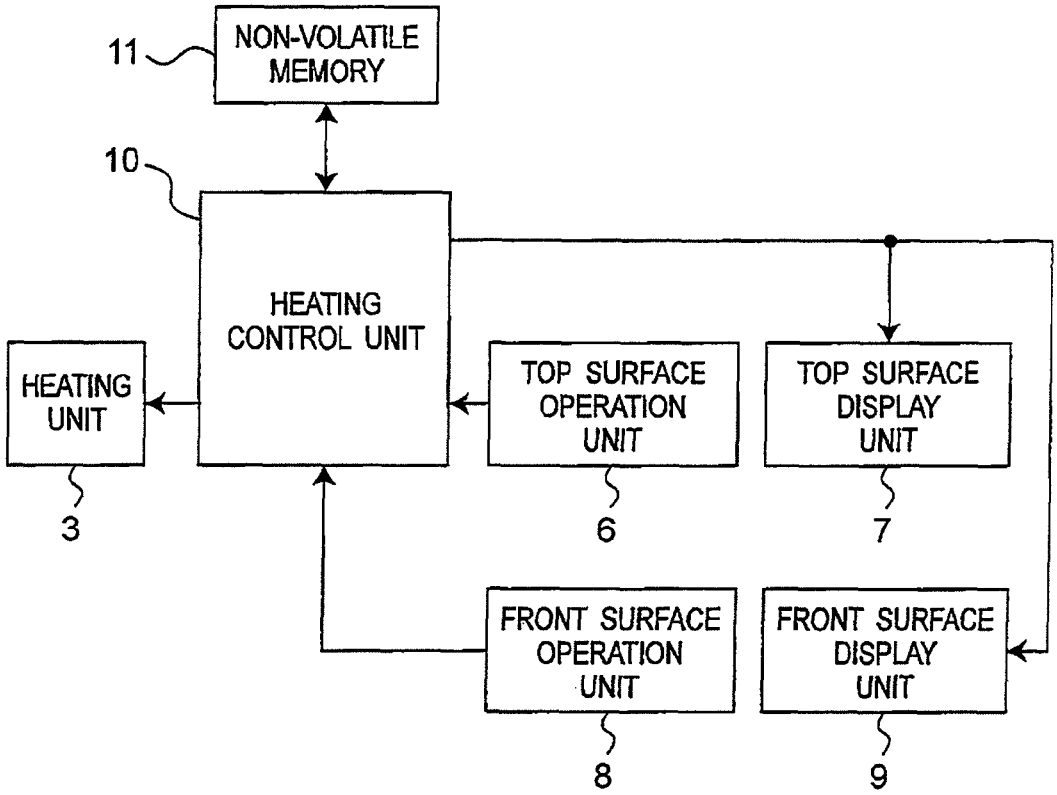
FIG. 9 is a block diagram showing the cooking device of the second embodiment of the present invention.

FIG. 9 shows a configuration of a cooking device of a second embodiment. The cooking device of the first embodiment is started up in the full mode when the power is turned on, but the cooking device of the second embodiment is started up in the stored operation mode (i.e., previously set operation mode).

The cooking device of the present embodiment further includes a non-volatile memory 11, which communicates with the heating control unit 10, in addition to the configuration of the first embodiment. The non-volatile memory 11 stores whether the cooking device is operating in the simple mode or is operating in the full mode.

In the present embodiment, the heating control unit 10 records, on the non-volatile memory 11, the operation state of the device (operation state indicating full mode or simple mode) when the main power of the cooking device is turned off by the user. When the main power of the cooking device is subsequently turned on, the heating control unit 10 reads the state of the device before the power switch 15 is turned off from the non-volatile memory 11. If the read state is the simple mode, for example, the indication 50 by the light-emitting element is displayed on the top surface display unit 7 over the down switch 6*e*, the up switch 6*f*, and the heating ON/OFF switch 6*g* to indicate that only the down switch 6*e*, the up switch 6*f*, and the heating ON/OFF switch 6*g* are usable, and to indicate that other switches cannot be operated, as shown in FIG. 7A. Furthermore, the "S mode" is displayed in the front surface display unit 9.

Therefore, in the present embodiment, the trouble of operating the selection switch 8*a* every time after the power is turned on can be saved since the operation mode before turning off the power is stored even if the power switch 15 of the cooking device is turned off.

Figure 10A:
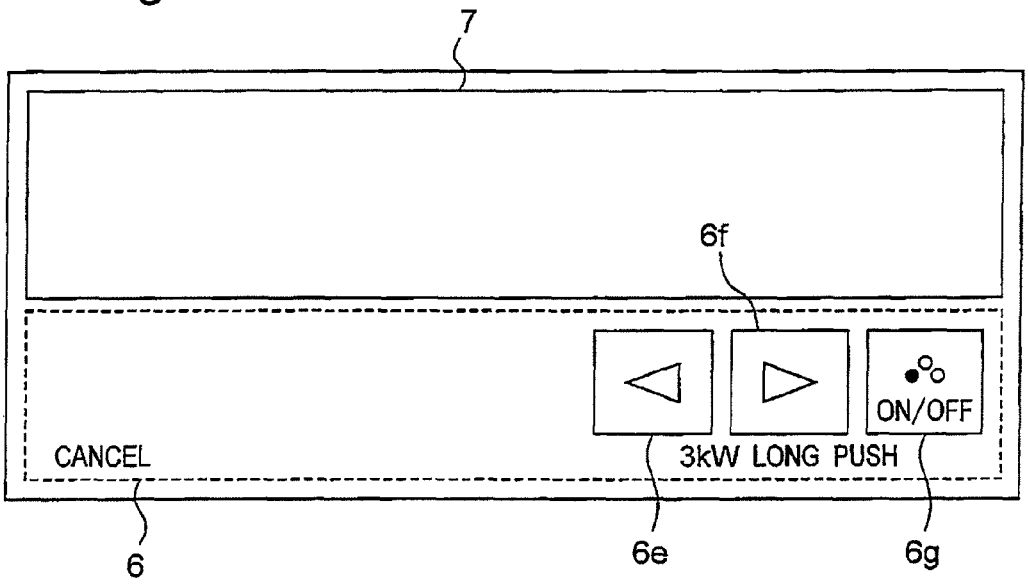
FIGS. 10A and 10B are views showing another display example of a simple mode after the power is turned on in the first and second embodiments of the present invention.
Figure 10B:
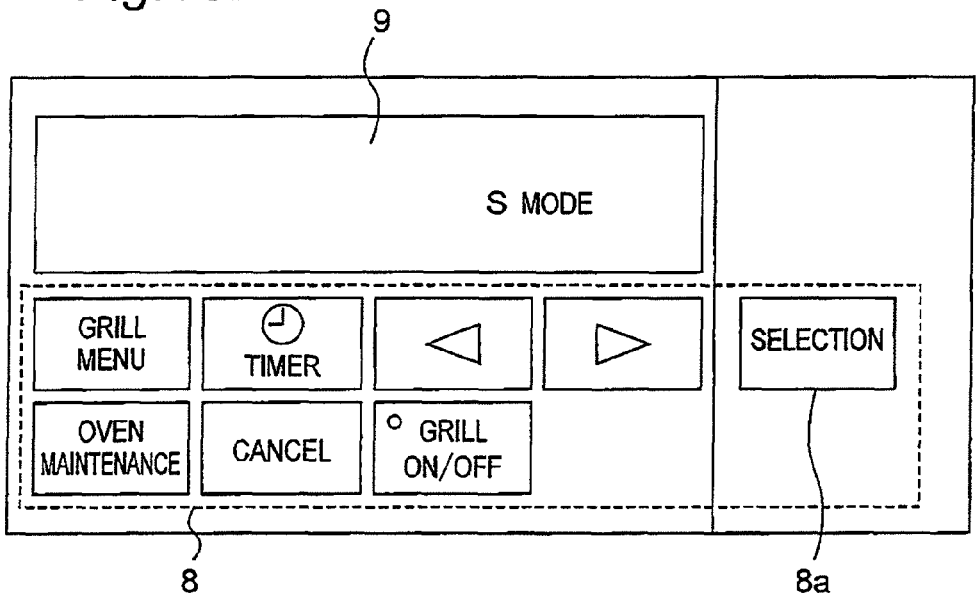

The enabled switches are indicated with the indication 50 in the first embodiment and the second embodiment, but the top surface operation unit 6 may have backlights corresponding to all of the plurality of switches 6*a* to 6*g* below each switch to notify only the enabled switches. A display example of the simple mode after the power is turned on in such a case is shown in FIGS. 10A and 10B. Only the switches 6*e*, 6*f*, 6*g* may be displayed by turning on the backlights arranged below the enabled switches 6*e*, 6*f*, 6*g*, and the switches 6*a*, 6*b*, 6*c*, 6*d* may not be displayed by turning off the backlights arranged below the disabled switches 6*a*, 6*b*, 6*c*, 6*d*. According to such a configuration, the user does not mistakenly operate the disabled switches.

In the first embodiment and the second embodiment, the automatic switch 6*c*, the fried-food OK/OFF switch 6*d*, and the heating ON/OFF switch 6*g* are individually arranged as control mode switches, but the configuration is not limited thereto. For example, a "menu switch" (not shown) may be arranged as the control mode switch, where the control mode to be selected may be changed in rotation every time the relevant switch is operated, and the heating ON/OFF switch may be operated after selecting the control mode to start heating. Therefore, two or more control mode switches may be operated to transit the control mode.

In the first embodiment and the second embodiment, the induction cooking device having the heating coil as the heating unit 3 has been described, but the present invention is not limited to this type of cooking device. A cooking device in which the heating unit is a radiant type, a halogen lamp type, or a gas type may also be adopted.

Industrial Applicability

The cooking device of the present invention has an effect in that a user who only uses basic functions can easily use the device having a great number of functions and a great number of switches, and is useful for a device having a great number of functions and a great number of switches, and the like.

The invention claimed is:

1. A cooking device comprising:

a main body serving as shell;

a top plate provided on an upper surface of the main body;

a heating unit operable to heat an object to be heated placed on the upper surface of the main body;

at least one control mode switch operable to select one of a plurality of control modes for controlling a heating operation of the heating unit;

at least one setting switch operable to select a set value in each control mode;

a heating control unit operable to control the heating unit based on the control mode and the set value inputted through the control mode switch and the setting switch; and a selection switch operable to select one operation mode from a plurality of operation modes; wherein the operation modes include a first operation mode in which all of the plurality of control modes are set to be selectable and a second operation mode in which only part of the plurality of control modes are set to be selectable; and the heating control unit sets only the control mode switch and the setting switch which are necessary for the control modes which are set to be selectable in the operation mode selected by the selection switch to be enabled.

2. A cooking device comprising:

a main body;

a top plate provided on an upper surface of the main body;

a heating unit operable to heat an object placed on the top plate;

a plurality of control mode switches operable to select one of a plurality of control modes for controlling a heating operation of the heating unit;

a setting switch operable to select a set value in each control mode;

a heating control unit operable to control the heating unit based on the control mode inputted through the control mode switches and the set value inputted through the setting switch; and a selection switch operable to select one operation mode from a plurality of operation modes, the operation modes including a first operation mode in which all of the plurality of control modes are set to be selectable and a second operation mode in which only part of the plurality of control modes are set to be selectable; and wherein the heating control unit disables at least one of the control mode switches when the second operation mode is selected by the selection switch.

3. The cooking device of claim 2, further comprising a first notifying unit operable to indicate which of the control mode switches are enabled.

4. The cooking device of claim 2, wherein at least two of the control mode switches are enabled when the second operation mode is selected by the selection switch, and wherein said at least two enabled control mode switches arranged are side by side.

5. The cooking device of claim 4, wherein the setting switch is enabled when the second operation mode is selected by the selection switch, and the setting switch is side by side with said at least two enabled control mode switches.

6. The cooking device of claim 2, further comprising:

a first notifying unit operable to indicate which of the control mode switches are enabled; and a second notifying unit operable to indicate whether the cooking device is operating in the first operation mode or in the second operation mode, wherein, when the disabled control mode switch is operated, at least one of the first notifying unit or the second notifying unit indicates that the operated control mode switch is disabled.

7. The cooking device of claim 2, wherein the setting switch is a first setting switch and the cooking device further comprises a second setting switch, wherein the heating control unit disables at least one of the setting switches when the second operation mode is selected by the selection switch.

8. The cooking device of claim 7, further comprising:

a first notifying unit operable to indicate which of the control mode switches are enabled; and a second notifying unit operable to indicate whether the cooking device is operating in the first operation mode or in the second operation mode, wherein, when the disabled control mode switch or the disabled setting switch is operated, at least one of the first notifying unit or the second notifying unit indicates that the operated control mode switch or the operated setting switch is disabled.

9. The cooking device of claim 2, wherein an operation of the selection switch is more difficult than operations of the control mode switches and the setting switch.

10. The cooking device of claim 2, wherein the selection switch is a switch which has an electrical contact and is operable to open or close, and wherein the control mode switch and the setting switch are touch switches of electrostatic capacity type.

11. The cooking device of claim 2, further comprising:

a power switch operable to disable all operations in an OFF state of the power switch and to enable at least one switch to be operated in an ON state of the power switch; and a non-volatile memory operable to store the operation mode selected by the selection switch when the power switch is in the ON state, wherein the cooking device operates in the stored operation mode when the power switch is turned on.

* * * * *